US007103551B2

(12) United States Patent
King et al.

(10) Patent No.: US 7,103,551 B2
(45) Date of Patent: Sep. 5, 2006

(54) COMPUTER NETWORK INCLUDING A COMPUTER SYSTEM TRANSMITTING SCREEN IMAGE INFORMATION AND CORRESPONDING SPEECH INFORMATION TO ANOTHER COMPUTER SYSTEM

(75) Inventors: Charles J. King, Austin, TX (US); Hidemasa Muta, Yokohama (JP); Richard Scott Schwerdtfeger, Round Rock, TX (US); Andrea Snow-Weaver, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 887 days.

(21) Appl. No.: 10/139,265

(22) Filed: May 2, 2002

(65) Prior Publication Data

US 2003/0208356 A1 Nov. 6, 2003

(51) Int. Cl.
*G10L 21/00* (2006.01)

(52) U.S. Cl. ..... 704/271; 704/270; 704/270.1

(58) Field of Classification Search ..... 704/270.1, 704/270

See application file for complete search history.

(56) References Cited

U.S. PATENT DOCUMENTS 5,186,629 A 2/1993 Rohen
5,223,828 A * 6/1993 McKiel, Jr. ..... 340/825.19

(Continued)

FOREIGN PATENT DOCUMENTS

CA 2 296 951 A1 7/2001

(Continued)

OTHER PUBLICATIONS

Morley et al. "Autiory Navigation in Hyperspace: Design and Evaluation of a Non-Visual Hypermedia System for Blind Users" Proc. of ASSETS 1998.*

(Continued)

*Primary Examiner*—David Hudspeth
*Assistant Examiner*—V. Paul Harper
(74) *Attorney, Agent, or Firm*—Carr LLP; Casimer K. Salys

(57) ABSTRACT

A described computer network includes a first computer system and a second computer system. The first computer system transmits screen image information and corresponding speech information to the second computer system. The screen image information includes information corresponding to a screen image intended for display within the first computer system. The speech information conveys a verbal description of the screen image. When the screen image includes one or more objects (e.g., menus, dialog boxes, icons, and the like) having corresponding semantic information, the speech information includes the corresponding semantic information. The second computer system responds to the speech information by producing an output (e.g., human speech via an audio output device, a tactile output via a Braille output device, and the like). The semantic information conveyed by the output allows a visually-impaired user of the second computer system to know intended purposes of the objects. The second computer system may also receive user input, generate an input signal corresponding to the user input, and transmit the input signal to the first computer system. The first computer system may respond to the input signal by updating the screen image. The semantic information conveyed by the output enables the visually-impaired user to properly interact with the first computer system.

22 Claims, 4 Drawing Sheets

U.S. PATENT DOCUMENTS

| | | | | |
|---|---|---|---|---|
| 5,630,060 | A | 5/1997 | Tang et al. | |
| 6,055,566 | A | 4/2000 | Kikinis | |
| 6,088,675 | A * | 7/2000 | MacKenty et al. | 704/270 |
| 6,115,686 | A | 9/2000 | Chung et al. | |
| 6,138,150 | A | 10/2000 | Nichols et al. | |
| 6,288,753 | B1 * | 9/2001 | DeNicola et al. | 348/586 |
| 6,442,523 | B1 * | 8/2002 | Siegel | 704/270 |
| 2001/0032074 | A1 | 10/2001 | Harris et al. | |
| 2001/0056348 | A1 | 12/2001 | Hyde-Thomson et al. | |
| 2002/0129100 | A1 * | 9/2002 | Dutta et al. | 709/203 |
| 2002/0178007 | A1 * | 11/2002 | Slotznick et al. | 704/270.1 |
| 2003/0124502 | A1 * | 7/2003 | Chou | 434/350 |
| 2004/0113908 | A1 * | 6/2004 | Galanes et al. | 345/418 |

FOREIGN PATENT DOCUMENTS

| | | |
|---|---|---|
| JP | 2001-100976 | 4/2001 |

OTHER PUBLICATIONS

Barnett et al., "Speech Output Display Terminal," *IBM Technical Disclosure Bulletin*, Mar. 1984, vol. 26, No. 10A, pp. 4950-4951.

Golding et al., Audio Response Terminal, *IBM Technical Disclosure Bulletin*, Mar. 1984, vol. 26, No. 10B, pp. 5633-5636.

Drumm et al., "Audible Cursor Positioning and Pixel Status Identification Mechanism," *IBM Technical Disclosure Bulletin*, Sep. 1984, vol. 27, No. 4B, p. 2528.

* cited by examiner

COMPUTER NETWORK INCLUDING A COMPUTER SYSTEM TRANSMITTING SCREEN IMAGE INFORMATION AND CORRESPONDING SPEECH INFORMATION TO ANOTHER COMPUTER SYSTEM

BACKGROUND OF THE INVENTION

1. Field of the Invention

This invention relates generally to computer networks, and, more particularly, to computer networks including multiple computer systems, wherein one of the computer systems sends screen image information to another one of the computer systems.

2. Description of the Related Art

The United States government has enacted legislation that requires all information technology purchased by the government to be accessible to the disabled. The legislation establishes certain standards for accessible Web content, accessible user agents (i.e., Web browsers), and accessible applications running on client desktop computers. Web content, Web browsers, and client applications developed according to these standards are enabled to work with assistive technologies, such as screen reading programs (i.e., screen readers) used by visually impaired users.

There is one class of applications, however, for which there is currently no accessible solution for visually impaired users. This class includes applications that allow computer system users (i.e., users of client computer systems, or "clients") to share a remote desktop running on another user's computer (e.g., on a server computer system, or "server"). At least some of these applications allow a user of a client to control an input device (e.g., a keyboard or mouse) of the server, and display the updated desktop on the client. Examples of these types of application include Lotus® Sametime®, Microsoft® NetMeeting®, Microsoft® Terminal Service, and Symantec® PCAnywhere® on Windows® platforms, and the Distributed Console Access Facility (DCAF) on OS/2® platforms. In these applications, bitmap images (i.e., bitmaps) of the server display screen are sent to the client for rerendering. Keyboard and mouse inputs (i.e., events) are sent from the client to the server to simulate the client user interacting with the server desktop.

An accessibility problem arises in the above described class of applications in that the application resides on the server machine, and only an image of the server display screen is displayed on the client. As a result, there is no semantic information at the client about the objects within the screen image being displayed. For example, if an application window being shared has a menu bar, a sighted user of the client will see the menu, and understand that he or she can select items in the menu. On the other hand, a visually impaired user of the client typically depends on a screen reader to interpret the screen, verbally describe that there is a menu bar (i.e., menu) displayed, and then verbally describe (i.e., read) the choices on the menu.

With no semantic information available at the client, a screen reader running on the client will only know that there is an image displayed. The screen reader will not know that there is a menu inside the image and, therefore, will not be able to convey that significance or meaning to the visually-impaired user of the client.

Current attempts to solve this problem have included use of optical character recognition (OCR) technology to extract text from the image, and create an off-screen model for processing by a screen reader. These methods are inadequate because they do not provide semantic information, are prone to error, and are difficult to translate.

SUMMARY OF THE INVENTION

A computer network is described including a first computer system and a second computer system. The first computer system transmits screen image information and corresponding speech information to the second computer system. The screen image information includes information corresponding to a screen image intended for display within the first computer system. The speech information conveys a verbal description of the screen image, and, when the screen image includes one or more objects (e.g., menus, dialog boxes, icons, and the like) having corresponding semantic information, the speech information includes the corresponding semantic information.

The second computer system may receive the speech information, and respond to the received speech information by producing an output (e.g., human speech via an audio output device, a tactile output via a Braille output device, and the like). When the screen image includes an object having corresponding semantic information, the output conveys the semantic information. The semantic information conveyed by the output allows a visually-impaired user of the second computer system to know intended purposes of the one or more objects in the screen image.

The second computer system may also receive user input, generate an input signal corresponding to the user input, and transmit the input signal to the first computer system. In response to the input signal, the first computer system may update the screen image. Where the user of the second computer system is visually impaired, the semantic information conveyed by the output enables the visually-impaired user to properly interact with the first computer system.

BRIEF DESCRIPTION OF THE DRAWINGS

The invention may be understood by reference to the following description taken in conjunction with the accompanying drawings, in which like reference numerals identify similar elements, and in which.

DETAILED DESCRIPTION OF SPECIFIC EMBODIMENTS

Illustrative embodiments of the invention are described below. In the interest of clarity, not all features of an actual implementation are described in this specification. It will, of course, be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 1:
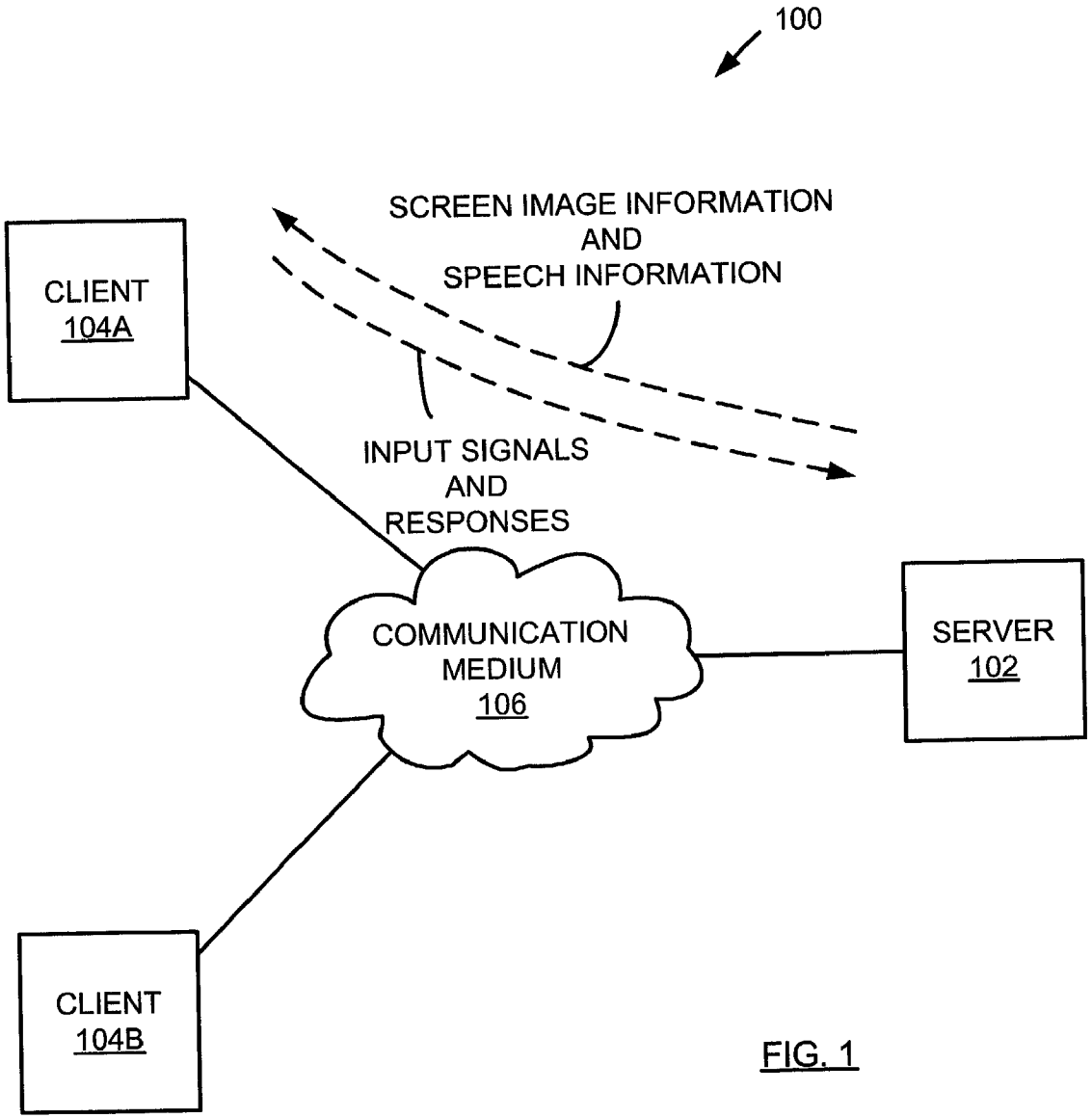
FIG. 1 is a diagram of one embodiment of a computer network including a server computer system (i.e., "server") coupled to multiple client computer systems (i.e., "clients") via a communication medium.

FIG. 1 is a diagram of one embodiment of a computer network 100 including a server computer system (i.e., "server") 102 coupled to multiple client computer systems (i.e., "clients") 104A–104B via a communication medium 106. The clients 104A–104B and the server 102 are typically located an appreciable distance (i.e., remote) from one another, and communicate with one another via the communication medium 106.

As will become evident, the computer network 100 requires only 2 computer systems to operate as described below: the server 102, and one of the clients, either the client 104A or client 104B. Thus, in general, the computer network 100 includes 2 or more computer systems.

As indicated in FIG. 1, the server 102 provides screen image information and corresponding speech information to the client 104A, and receives input signals and responses from the client 104A. In general, the server 102 may provide screen image information and corresponding speech information to any client, or all clients, of the computer network 100, and receive input signals from any one of the clients.

In general, the screen image information is information regarding a screen image generated within the server 102, and intended for display within the server 102 (e.g., on a display screen of a display system of the server 102). The corresponding speech information conveys a verbal description of the screen image. The speech information may include, for example, general information about the screen image, and also any objects within the screen image. Common objects, or display elements, include menus, boxes (e.g., dialog boxes, list boxes, combination boxes, and the like), icons, text, tables, spreadsheets, Web documents, Web page plugins, scroll bars, buttons, scroll panes, title bars, frames split bars, tool bars, and status bars. An "icon" is a picture or image that represents a resource, such as a file, device, or software program. General information about the screen image, and also any objects within the screen image, may include, for example, colors, shapes, and sizes.

More importantly, the speech information also includes semantic information corresponding to objects within the screen image. As will be described in detail below, this semantic information about the objects allows a visually-impaired user of the client 104A to interact with the objects in a proper, meaningful, and expected way.

In general, the server 102 and the clients 104A–104B communicate via signals, and the communication medium 106 provides means for conveying the signals. The server 102 and the clients 104A–104B may each include hardware and/or software for transmitting and receiving the signals. For example, the server 102 and the clients 104A–104B may communicate via electrical signals. In this case, the communication medium 106 may include one or more electrical cables for conveying the electrical signals. The server 102 and the clients 104A–104B may each include a network interface card (NIC) for generating the electrical signals, driving the electrical signals on the one or more electrical cables, and receiving electrical signals from the one or more electrical cables. The server 102 and the clients 104A–104B may also communicate via optical signals, and communication medium 106 may include optical cables. The server 102 and the clients 104A–104B may also communicate via electromagnetic signals (e.g., radio waves), and communication medium 106 may include air.

It is noted that communication medium 106 may, for example, include the Internet, and various means for connecting to the Internet. In this case, the clients 104A–104B and the server 102 may each include a modem (e.g., telephone system modem, cable television modem, satellite modem, and the like). Alternately, or in addition, communication medium 106 may include the public switched telephone network (PSTN), and clients 104A–104B and the server 102 may each include a telephone system modem.

In the embodiment of FIG. 1, the computer network 100 is a client-server computer network wherein the clients 104A–104B rely on the server 102 for various resources, such as files, devices, and/or processing power. It is noted, however, that in other embodiments, the computer network 100 may be a peer-to-peer network. In a peer-to-peer network embodiment, the server 102 may be viewed as a "master" computer system by virtue of generating the image information and the speech information, providing the screen image information and the speech information to one or more of the clients 104A–104B, and receiving input signals and/or responses from the one or more of the clients 104A–104B. In receiving the screen image information and the speech information from the server 102, and providing input signals and/or responses to the server 102, the one or more of the clients 104A–104B may be viewed as a "slave" computer system. It is noted that in a peer-to-peer network embodiment, any one of the computer systems of the computer network 100 may be the master computer system, and one or more of the other computer systems may be slaves.

Figure 2:
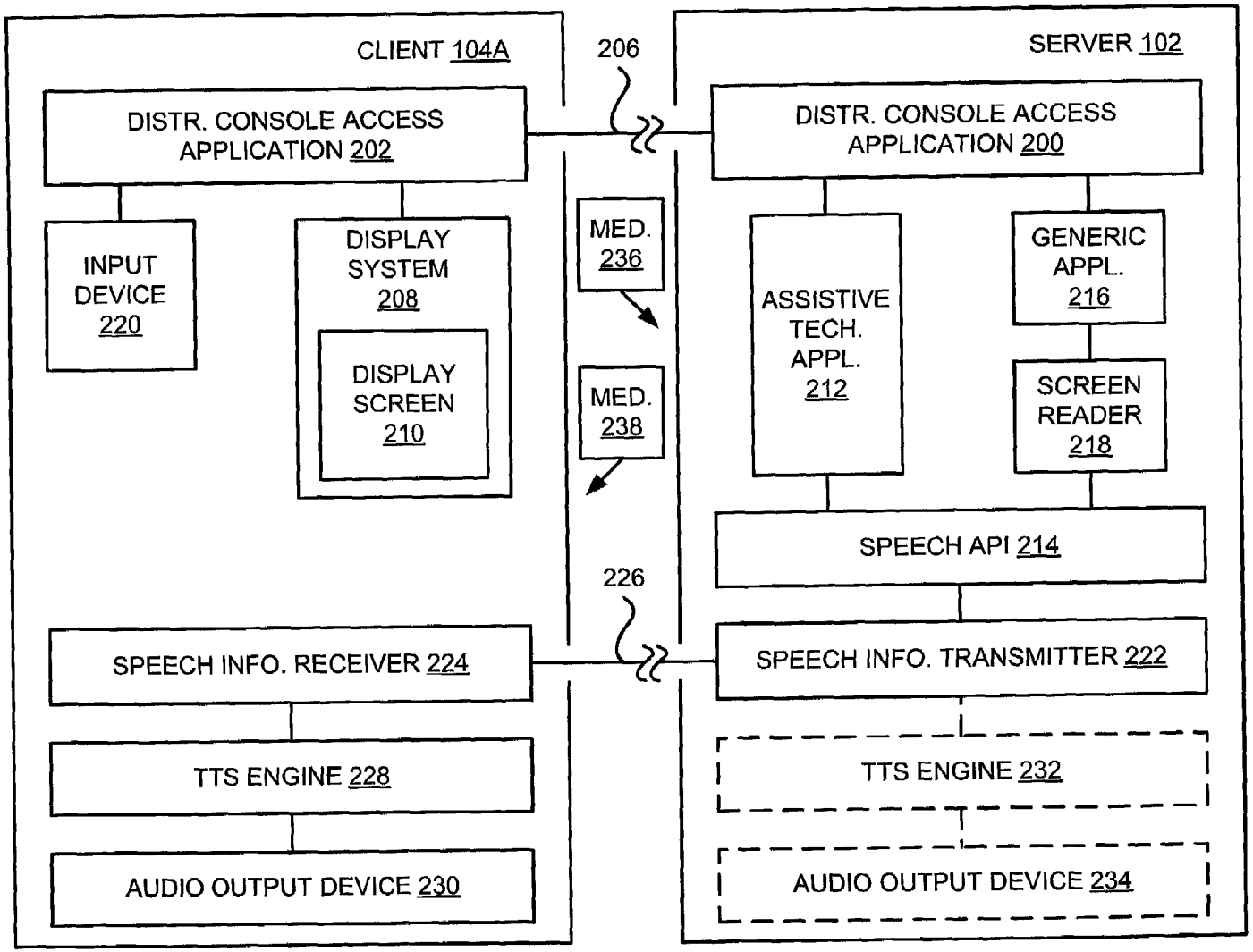
FIG. 2 is a diagram illustrating embodiments of the server and one of the clients of FIG. 1, wherein a user of the one of the clients is able to interact with the server as if the user were operating the server locally.

FIG. 2 is a diagram illustrating embodiments of the server 102 and the client 104A of FIG. 1, wherein a user of the client 104A is able to interact with the server 102 as if the user were operating the server 102 locally. It is noted that in the embodiment of FIG. 2, the server 102 may also provide screen image information and/or speech information to the client 104B of FIG. 1, and may receive responses from the client 104B.

In the embodiment of FIG. 2, the server 102 includes a distributed console access application 200, and the client 104A includes a distributed console access application 202. The distributed console access application 200 receives screen image information generated within the server 102, and provides the screen image information to the distributed console access application 202 via a communication path or channel 206 formed between the server 102 and the client 104A. Suitable software embodiments of the distributed console access applications 200 and the distributed console access application 202 are known and commercially available.

The screen image information is information regarding a screen image generated within the server 102, and intended for display to a user of the server 102. Thus the screen image would expectedly be displayed on a display screen of a display system of the server 102. The screen image information may include, for example, a bit map representation of the screen image, wherein the screen image is divided into rows and columns of "dots," and one or more bits are used to represent specific characteristics (e.g., color, shades of gray, and the like) of each of the dots.

In the embodiment of FIG. 2, the distributed console access application 202 within the client 104A is coupled to a display system 208 including a display screen 210. The distributed console access application 202 receives the screen image information from the distributed console access application 200 within the server 102, and provides the screen image information to the display system 208. The display system 208 uses the screen image information to display the screen image on the display screen 210. For example, the display system 208 may use the screen image information to generate picture elements (pixels), and display the pixels on the display screen 210.

It is noted that where the server 102 includes a display system similar to that of the display system 208 of the client 104A, the screen image is expectedly displayed on the display screens of the user 102 and the client 104A at substantially the same time. (It is noted that communication delays between the server 102 and the client 104A may prevent the screen image from being displayed on the display screens of the user 102 and the client 104A at exactly the same time.)

The communication path or channel 206 is formed through the communication medium 106 of FIG. 1. It is also noted that where the communication medium 106 of FIG. 1 includes the Internet, the server 102 and the client 104A may, for example, communicate via software communication facilities called sockets. In this situation, a socket of the client 104A may issue a connect request to a numbered service port of a socket of the server 102. Once the socket of the client 104A is connected to the numbered service port of the socket of the server 102, the client 104A and the server 102 may communicate via the sockets by writing data to, and reading data from, the numbered service port.

In the embodiment of FIG. 2, the server 102 includes an assistive technology application 212. In general, assistive technology applications are software programs that facilitate access to technology (e.g., computer systems) for visually impaired users. When executed within the server 102, the assistive technology application 212 produces the screen image information described above, and provides the screen image information to the distributed console access application 200.

During execution, the assistive technology application 212 also produces speech information corresponding to the screen image information. In the embodiment of FIG. 2, the speech information conveys human speech which verbally describes general attributes (e.g., color, shape, size, and the like) of the screen image and any objects (e.g., menus, dialog boxes, icons, text, and the like) within the screen image, and also includes semantic information conveying the meaning, significance, or intended purpose of each of the objects within the screen image. The speech information may include, for example, text-to-speech (TTS) commands and/or audio output signals. Suitable assistive technology applications are known and commercially available.

In the embodiment of FIG. 2, the assistive technology application 212 provides the speech information to a speech application program interface (API) 214. The speech application program interface (API) 214 provides a standard means of accessing routines and services within an operating system of the server 102. Suitable speech application program interfaces (APIs) are known and commonly available.

In the embodiment of FIG. 2, the server 102 also includes a generic application 216. As used herein, the term "generic application" refers to a software program that produces screen image information, but does not produce corresponding speech information. When executed within the server 102, the generic application 216 produces the screen image information described above, and provides the screen image information to the distributed console access application 200. Suitable generic applications are known and commercially available.

During execution, the generic application 216 also produces accessibility information, and provides the accessibility information to a screen reader 218. Further, the screen reader 218 may monitor the behavior of the generic application 216, and produce accessibility information dependent upon the behavior of the generic application 216. In general, a screen reader is a software program that uses screen image information to produce speech information, wherein the speech information includes semantic information of objects (e.g., menus, dialog boxes, icons, and the like) within the screen image. This semantic information allows a visually impaired user to interact with the objects in a proper, meaningful, and expected way. The screen reader 218 uses the received accessibility information, and the screen image information available within the server 102, to produce the above described speech information. The screen reader 218 provides the speech information to the speech application program interface (API) 214. Suitable screen reading applications (i.e., screen readers) are known and commercially available.

It is noted that the server 102 need not include both the assistive technology application 212, and the combination of the generic application 216 and the screen reader 218, at the same time. For example, the server 102 may include the assistive technology application 212, and may not include the generic application 216 and the screen reader 218. Conversely, the server 102 may include the generic application 216 and the screen reader 218, and may not include the assistive technology application 212. This is supported by the fact that in a typical multi-tasking computer system operating environment, only one software program is actually being executed at any given time.

In the embodiment of FIG. 2, the distributed console access application 200 of the server 102 and the distributed console access application 202 of the client 104A are configured to cooperate such that the user of the client 104A is able to interact with the server 102 as if the user were operating the server 102 locally. As shown in FIG. 2, the client 104A includes an input device 220. The input device 220 may be for example, a keyboard, a mouse, or a voice recognition system. When the user of the client 104A activates the input device 220 (e.g., presses a keyboard key, moves a mouse, or activates a mouse button), the input device 220 produces one or more input signals (i.e., "input signals"), and provides the input signals to the distributed console access application 202. The distributed console access application 202 transmits the input signals to the distributed console access application 200 of the server 102.

The distributed console access application 200 provides the input signals to either the assistive technology 212 or the generic application 216 (e.g., just as if the user activated a similar input device of the server 102). In response to the input signals, the assistive technology 212 or the generic application 216 typically responds to the input signals by updating the screen image information, and proving the updated screen image information to the distributed console access application 200 as described above. As a result, a new screen image is typically displayed on the display screen 210 of the client 104A.

For example, where the input device 220 is a mouse used to control the position of a pointer displayed on the display screen 210 of the display system 208, the user of the client 104A may move the mouse to position the pointer over an icon within the displayed screen image. Where the icon represents a software program (e.g., the assistive technology program 212 or the generic application 216), the user of the client 104A may initiate execution of the software program by activating (i.e., clicking) a button of the mouse. In response, the distributed console access application 200 of the server 102 may provide the mouse click input signal to the operating system of the server 102, and operating system may initiate execution of the software program. During this process, the screen image, displayed on the display screen 210 of the client 104A, may be updated to reflect initiation of the software program execution.

In the embodiment of FIG. 2, the speech application program interface (API) 214 provides the speech information, received from the assistive technology application 212 and the screen reader 218 (at different times), and provides the speech information to a speech information transmitter 222 within the server 102. The speech information transmitter 222 transmits the speech information to a speech information receiver 224 of the client 104A via a communication path or channel 226 formed between the server 102 and the client 104A, and via the communication medium 106 of FIG. 1. It is noted that in the embodiment of FIG. 2, the communication path 226 is separate and independent from the communication path 206 described above. The speech information receiver 224 provides the speech information to a text-to-speech (TTS) engine 228.

As described above, the speech information may include text-to-speech (TTS) commands. In this situation, the text-to-speech (TTS) engine 228 converts the text-to-speech (TTS) commands to audio output signals, and provides the audio output signals to an audio output device 230. The audio output device 230 may include, for example, a sound card and one or more speakers. As described above, the speech information may include also include audio output signals. In this situation, the text-to-speech (TTS) engine 228 may simply pass the audio output signals to the audio output device 230.

The speech information transmitter 222 may also transmit audio information (e.g., beeps) to the speech information receiver 224 of the client 104A in addition to the speech information. The text-to-speech (TTS) engine 228 may simply pass the audio information to the audio output device 230.

When the user of the client 104A is visually impaired, the user may not be able to see the screen image displayed on the display screen 210 of the client 104A. However, when the audio output device 230 produces the verbal description of the screen image, the visually-impaired user may hear the description, and understand not only the general appearance of the screen image and any objects within the screen image (e.g., color, shape, size, and the like), but also the meaning, significance, or intended purpose of any objects within the screen image as well (e.g., menus, dialog boxes, icons, and the like). This ability for a visually-impaired user to hear the verbal description of the screen image and to know the meaning, significance, or intended purpose of any objects within the screen image allows the user of the client 104A to interact with the objects in a proper, meaningful, and expected way.

The various components of the server 102 typically synchronize their actions via various handshaking signals, referred to generally herein as response signals, or responses. In the embodiment of FIG. 2, the audio output device 230 may provide responses to the text-to-speech (TTS) engine 228, and the text-to-speech (TTS) engine 228 may provide responses to the speech information receiver 224.

As indicated in FIG. 2, the speech information receiver 224 within the client 104A may provide response signals to the speech information transmitter 222 within the server 102 via the communication path or channel 226. The speech information transmitter 222 may provide response signals to the speech application program interface (API) 214, and so on.

It is noted that the speech information transmitter 222 may transmit speech information to, and receive responses from, multiple clients. In this situation, the speech information transmitter 222 may receive the multiple responses, possibly at different times, and provide a single, unified, representative response to the speech application program interface (API) 214 (e.g., after the speech information transmitter 222 receives the last response).

As indicated in FIG. 2, the server 102 may also include an optional text-to-speech (TTS) engine 232, and an optional audio output device 234. The speech information transmitter 222 may provide speech information to the optional text-to-speech (TTS) engine 232, and the optional text-to-speech (TTS) engine 232 and audio output device 234 may operate similarly to the text-to-speech (TTS) engine 228 and the audio output device 230, respectively, of the client 104A. The speech information transmitter 222 may receive a response from the optional text-to-speech (TTS) engine 232, as well as from multiple clients. As described above, the speech information transmitter 222 may receive the multiple responses, possibly at different times, and provide a single, unified, representative response to the response to the speech application program interface (API) 214 (e.g., after the speech information transmitter 222 receives the last response).

It is noted that the speech information transmitter 222 and/or the speech information receiver 224 may be embodied within hardware and/or software. A carrier medium 236 may be used to convey software of the speech information transmitter 222 to the server 102. For example, the server 102 may include a disk drive for receiving removable disks (e.g., a floppy disk drive, a compact disk read only memory or CD-ROM drive, and the like), and the carrier medium 236 may be a disk (e.g., a floppy disk, a CD-ROM disk, and the like) embodying software (e.g., computer program code) for receiving the speech information corresponding to the screen image information, and transmitting the speech information to the client 104A.

Similarly, a carrier medium 238 may be used to convey software of the speech information receiver 224 to the client 104A. For example, the client 104A may include a disk drive for receiving removable disks (e.g., a floppy disk drive, a compact disk read only memory or CD-ROM drive, and the like), and the carrier medium 238 may be a disk (e.g., a floppy disk, a CD-ROM disk, and the like) embodying software (e.g., computer program code) for receiving the speech information corresponding to the screen image information from the server 102, and providing the speech information to an output device of the client 104A (e.g., the audio output device 230 via the TTS engine 228).

In the embodiment of FIG. 2, the server 102 is configured to the transmit screen image information, and the corresponding speech information, to the client 104A. It is noted that there need not be any fixed timing relationship between the transmission and/or reception of the speech information and the screen image information. In other words, the transmission and/or reception of the speech information and the screen image information need not be synchronized in any way.

Further, the server 102 may send speech information to the client 104A without updating the screen image displayed on the display screen 210 of the client 104A (i.e., without sending corresponding screen image information). For example, where the input device 220 of the client 104A is a keyboard, the user of the client 104A may enter a key sequence via the input device 220 that forms a command to the screen reader 218 in the server 102 to "read the whole screen." In this situation, the key sequence input signals may be transmitted to the server 102, and passed to the screen reader 218 in the server 102. The screen reader 102 may respond to the command to "read the whole screen" by producing speech information indicative of the contents of the current screen image. As a result, the speech information indicative of the contents of the current screen image may be passed to the client 104A, and the audio output device 230 of the client 104A may produce a verbal description of the contents of the current screen image. During this process, the screen image, displayed on the display screen 210 of the client 104A, expectedly does not change, and no new screen image information is transferred from the server 102 to the client 104A. In this situation, the screen image transmitting process is not involved.

Figure 3:
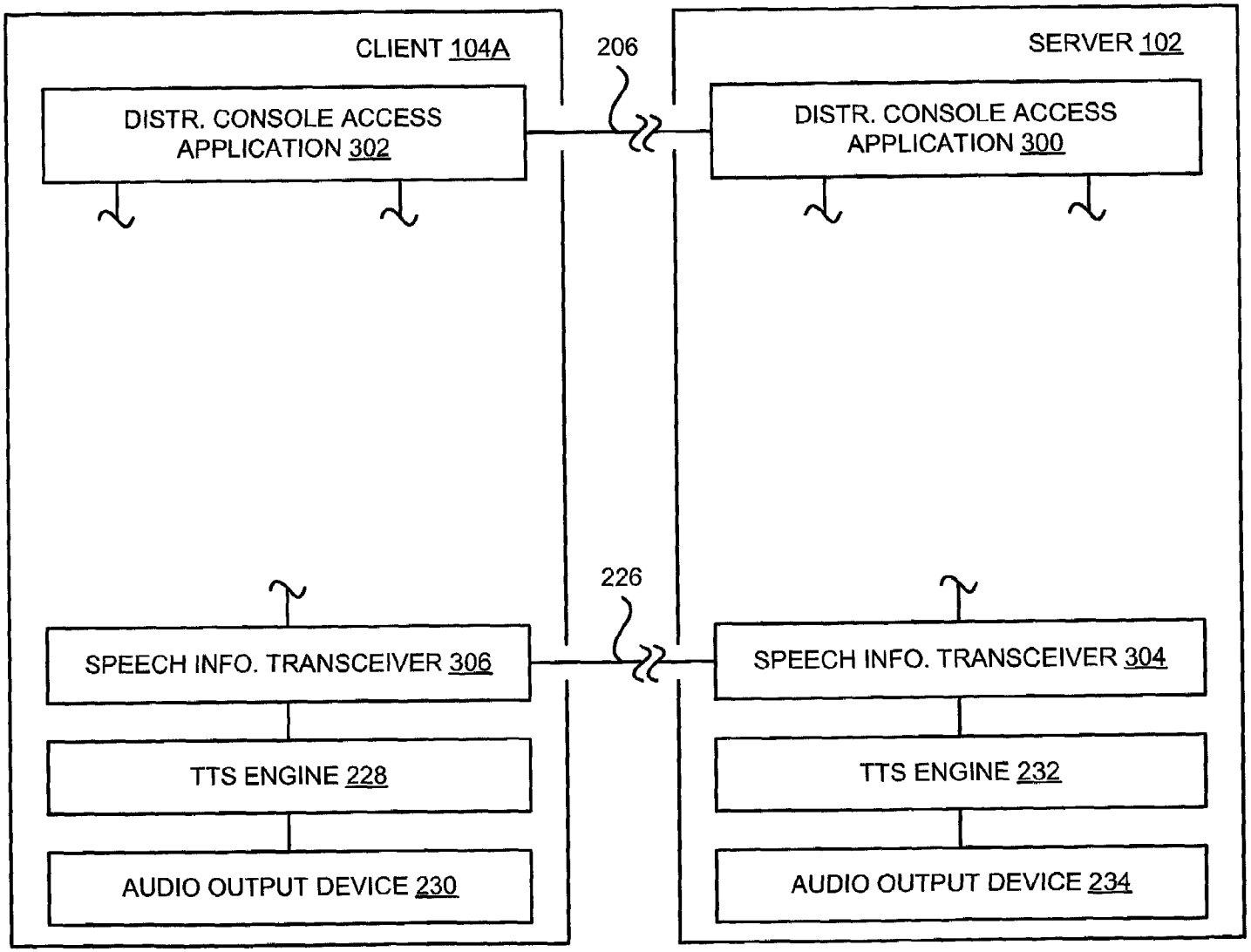
FIG. 3 is a diagram illustrating embodiments of the server and the one of the clients of FIG. 2, wherein the server and the one of the clients are configured similarly to facilitate assignment as either a master computer system or a slave computer system in a peer-to-peer embodiment of the computer network of FIG. 1.

FIG. 3 is a diagram illustrating embodiments of the server 102 and the client 104A of FIG. 2, wherein the server 102 and the client 104A are configured similarly to facilitate assignment as either a master computer system or a slave computer system in a peer-to-peer embodiment of the computer network 100 (FIG. 1). It is noted that in the embodiment of FIG. 3, both the server 102 and the client 104A may include separate instances of the input device 220 (FIG. 2), the display system 208 including the display screen 210 (FIG. 2), the assistive technology application 212 (FIG. 2), the generic application 216 (FIG. 2), the screen reader 218 (FIG. 2), and the speech API 214 (FIG. 2).

In the peer-to-peer embodiment, any one the computer systems of the computers network 100 may generate and provide the screen image information and the speech information to one or more of the other computer systems, and receive input signals and/or responses from the one or more of the other computer systems, and thus be viewed as the master computer system as described above. In this situation, the one or more of the other computer systems are considered slave computer systems.

In the embodiment of FIG. 3, the distributed console access application 200 of the server 102 is replaced by a distributed console access application 300, and the distributed console access application 202 of the client 104A is replaced by a distributed console access application 300. The distributed console access application 300 of the server 102 and the distributed console access application 302 of the client 104A are identical, and separately configurable to transmit or receive screen image information and input signals as described above. In place of the speech information transmitter 222 of FIG. 2, the server 102 includes a speech information transceiver 304. In place of the speech information receiver 224, the client 104A includes a speech information transceiver 306. The speech information transceiver 304 and the speech information transceiver 306 are identical, and separately configurable to transmit or receive speech information and responses as described above. It is noted that in FIG. 3, the server 102 includes the optional text-to-speech (TTS) engine and the optional audio output device 234 of FIG. 2.

Figure 4:
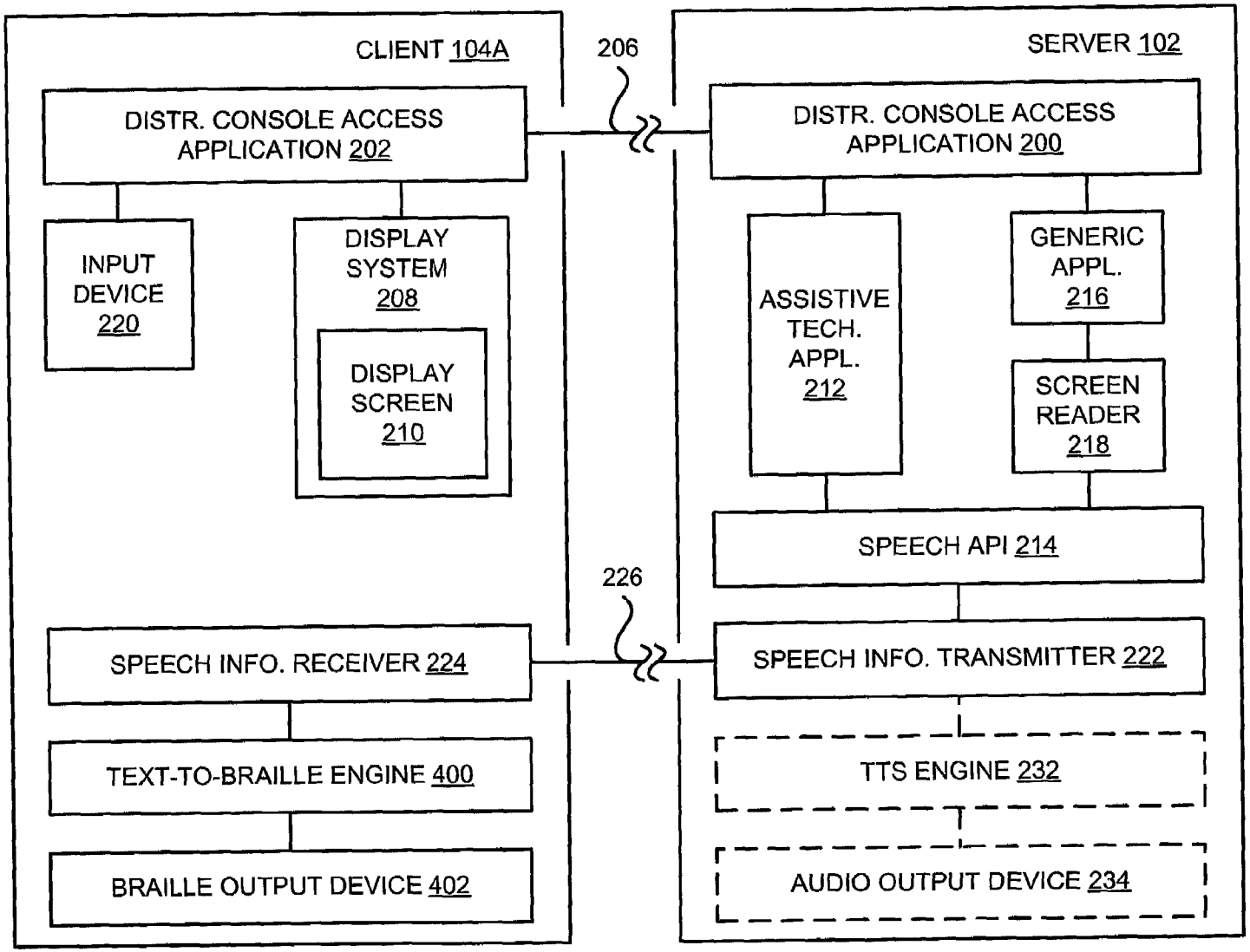
FIG. 4 is a diagram illustrating embodiments of the server and the one of the clients of FIG. 2, wherein a text-to-speech (TTS) engine of the one of the clients is replaced by a text-to-Braille engine, and an audio output device within the one of the clients is replaced by a Braille output device.

FIG. 4 is a diagram illustrating embodiments of the server 102 and the client 104A of FIG. 2, wherein the text-to-speech (TTS) engine 228 is replaced by a text-to-Braille engine 400, and the audio output device 230 of FIG. 2 is replaced by a Braille output device 402. In the embodiment of FIG. 4, the text-to-Braille engine 400 converts the text-to-speech (TTS) commands or audio output signals of the speech information to Braille output signals, and provides the Braille output signals to the Braille output device 402. A typical Braille output device includes 20–80 Braille cells, each Braille cell including 6 or 8 pins which move up and down to form a tactile display of Braille characters.

When the Braille output device 402 produces the Braille characters, the visually-impaired user of the client 104A may understand not only the general appearance of the screen image and any objects within the screen image (e.g., color, shape, size, and the like), but also the meaning, significance, or intended purpose of any objects within the screen image as well (e.g., menus, dialog boxes, icons, and the like). This ability allows the visually-impaired user to interact with the objects in a proper, meaningful, and expected way.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A computer network, comprising:

a first computer system designed to interact with a visually impaired user and configured to transmit screen image information and corresponding speech information to another computer system, wherein the screen image information includes information corresponding to a screen image intended for display within the first computer system, and wherein the speech information conveys a verbal description of the screen image, and wherein in the event the screen image includes an object having corresponding semantic information, the speech information includes the semantic information; and a second computer system in communication with the first computer system, wherein the second computer system is configured to receive user input from a user of the second computer system, to generate an input signal corresponding to the user input, and to transmit the input signal to the first computer system, and wherein in response to the user input the first computer system transmits updated screen image information and corresponding speech information;

wherein the visually impaired user interacts with the first computer system through the use of the second computer system.

2. The computer network as recited in claim 1, wherein the second computer system is configured to receive the speech information, and to respond to the received speech information by producing an output, and wherein in the event the screen image includes an object having corresponding semantic information, the output conveys to a user the semantic information corresponding to the object.

3. The computer network as recited in claim 2, wherein in the event the screen image includes an object having corresponding semantic information, the output produced by the second computer system conveys to a visually-impaired user information concerning an intended purpose of the object.

4. The computer network as recited in claim 2, wherein the second computer system is configured to respond to the received speech information by producing human speech conveying the semantic information.

5. The computer network as recited in claim 2, wherein the second computer system is configured to respond to the received speech information by producing a tactile output conveying the semantic information.

6. The computer network as recited in claim 1, wherein in the event a user of the second computer system is visually impaired, and in the event the screen image includes an object having corresponding semantic information, the speech information including the semantic information transmitted from the first computer system to the second computer system enables the visually-impaired user to properly interact with the first computer system.

7. The computer network as recited in claim 1, wherein the second computer system comprises a display screen, and wherein the second computer system is configured to receive the screen image information, and to respond to the received screen image information by displaying the screen image on the display screen.

8. The computer network as recited in claim 1, wherein in the event the screen image includes an object having corresponding semantic information, the semantic information conveys an intended purpose of the object.

9. The computer network as recited in claim 1, wherein objects having corresponding semantic information include menus, dialog boxes, and icons.

10. The computer network as recited in claim 1, wherein the screen image information comprises a bit map of the screen image.

11. The computer network as recited in claim 1, wherein in the event the screen image includes an object having corresponding semantic information and comprising text, the speech information includes the semantic information and the text.

12. A computer network, comprising:

a first computer system designed to interact with a visually impaired user and configured to:

transmit screen image information and corresponding speech information, wherein the screen image information includes information corresponding to a screen image intended for display within the first computer system, and wherein the speech information conveys a verbal description of the screen image, and wherein in the event the screen image includes an object having corresponding semantic information, the speech information includes the semantic information;

receive an input signal, and respond to the input signal by updating the screen image;

a second computer system configured to:

receive user input from a user of the second computer system;

generate the input signal dependent upon the user input;

transmit the input signal to the first computer system; and receive the speech information, and respond to the received speech information by producing an output, wherein in the event the screen image includes an object having corresponding semantic information, the output conveys the semantic information;

wherein the visually impaired user interacts with the first computer system through the use of the second computer system.

13. The computer network as recited in claim 12, wherein in the event the user of the second computer system is visually impaired and the screen image includes an object having corresponding semantic information, the semantic information conveyed by the output enables the visually-impaired user to properly interact with the first computer system.

14. The computer network as recited in claim 12, wherein the second computer system is configured to respond to the received speech information by producing human speech conveying the semantic information.

15. The computer network as recited in claim 12, wherein the second computer system is configured to respond to the received speech information by producing a tactile output conveying the semantic information.

16. The computer network as recited in claim 12, wherein the second computer system comprises a display screen, and wherein the second computer system is configured to receive the screen image information, and to respond to the received screen image information by displaying the screen image on the display screen.

17. A first computer system, comprising:

a distributed console access application configured to receive screen image information from a second computer system designed to interact with a visually impaired user, wherein the screen image information includes information corresponding to a screen image intended for display within the second computer system;

a speech information receiver configured to receive speech information, corresponding to the screen image information, from the second computer system, wherein the speech information conveys a verbal description of the screen image; and an output device coupled to receive audio output signals and configured to produce an output, wherein the audio output signals are indicative of the speech information, and wherein the output conveys a description of the screen image;

wherein in the event that screen image includes an object having corresponding semantic information, the speech information includes the semantic information, and the output conveys the semantic information;

wherein the first computer system is configured to receive user input from a user of the first computer system, to generate an input signal corresponding to the user input, and to transmit the input signal to the second computer system, and wherein in response to the user input the second computer system transmits updated screen image information and corresponding speech information; and wherein the visually impaired user interacts with the second computer system through the use of the first computer system.

18. The computer system as recited in claim 17, wherein the distributed console access application is coupled to receive the input signal, and configured to transmit the input signal to the second computer system.

19. The computer system as recited in claim 17, wherein the output device comprises an audio output device producing human speech that conveys a verbal description of the screen image.

20. The computer system as recited in claim 17, wherein the output device comprises a Braille output device producing a tactile output that conveys the description of the screen image.

21. A method for conveying speech information from a first computer system to a second computer system, wherein the first computer system is designed to interact with a visually impaired user, comprising:

receiving speech information corresponding to screen image information, wherein the screen image information includes information corresponding to a screen image intended for display within the first computer system, and wherein the speech information conveys a verbal description of the screen image;

transmitting the speech information to the second computer system;

receiving user input from a user of the second computer system;

generating an input signal corresponding to the user input by the second computer system;

transmitting the input signal to the first computer system;

wherein in the event the screen image includes an object having corresponding semantic information, the speech information includes the semantic information;

wherein in response to the user input, transmitting updated screen image information and corresponding speech information by the first computer system; and wherein the visually impaired user interacts with the first computer system through the use of the second computer system.

22. A method for producing an output within a first computer system, comprising:

receiving speech information corresponding to screen image information from a second computer system designed to interact with a visually impaired user, wherein the screen image information includes information corresponding to a screen image intended for display within the second computer system, and wherein the speech information conveys a verbal description of the screen image; and providing the speech information to an output device of the first computer system receiving user input from a user of the first computer system;

generating an input signal corresponding to the user input by the first computer system;

transmitting the input signal to the second computer system;

wherein in the event the screen image includes an object having corresponding semantic information, the speech information includes the semantic information;

wherein in response to the user input, transmitting updated screen image information and corresponding speech information by the second computer system; and wherein the visually impaired user interacts with the second computer system through the use of the first computer system.

* * * * *